US009885972B2

(12) United States Patent
Wada et al.

(10) Patent No.: US 9,885,972 B2
(45) Date of Patent: Feb. 6, 2018

(54) IMAGE FORMING APPARATUS THAT ENSURES SETTING SURFACE POTENTIAL OF PHOTORECEPTOR DRUM WITH SIMPLE CONSTITUTION

(71) Applicant: KYOCERA Document Solutions Inc., Osaka (JP)

(72) Inventors: Minoru Wada, Osaka (JP); Masaru Hatano, Osaka (JP); Masaki Kadota, Osaka (JP); Masahito Ishino, Osaka (JP); Keisuke Isoda, Osaka (JP); Atsushi Ishizaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/277,751

(22) Filed: Sep. 27, 2016

(65) Prior Publication Data

US 2017/0090334 A1 Mar. 30, 2017

(30) Foreign Application Priority Data

Sep. 30, 2015 (JP) ..... 2015-193569

(51) Int. Cl.
*G03G 15/02* (2006.01)
*G03G 15/06* (2006.01)

(52) U.S. Cl.
CPC ..... *G03G 15/0266* (2013.01); *G03G 15/065* (2013.01)

(58) Field of Classification Search
CPC ..... G03G 15/0266; G03G 15/0275; G03G 15/065
See application file for complete search history.

(56) References Cited

U.S. PATENT DOCUMENTS

2010/0092198 A1* 4/2010 Shirafuji ..... G03G 15/0178 399/66

FOREIGN PATENT DOCUMENTS

| | | | | |
|---|---|---|---|---|
| JP | 55028059 A | * | 2/1980 | |
| JP | 58221858 A | * | 12/1983 | ..... G03G 15/5037 |
| JP | 07199563 A | * | 8/1995 | |
| JP | 9-106142 A | | 4/1997 | |
| JP | 2000338732 A | * | 12/2000 | |

OTHER PUBLICATIONS

Machine translation of Ohashi (1995).*

* cited by examiner

*Primary Examiner* — Sevan A Aydin
(74) *Attorney, Agent, or Firm* — Stein IP, LLC

(57) ABSTRACT

An image forming includes an apparatus main body, a photoreceptor drum, a charging apparatus, a developing device, a transfer apparatus, a charging bias applying unit, a developing bias applying unit, a bias adjusting unit, and a print density measurement unit. The bias adjusting unit forms a non-charged area on a circumference surface of the photoreceptor drum and applies a developing bias constituted of a first electric potential to a developing roller to form a first toner image by an electric potential difference between the non-charged area and the developing roller. The charging bias applying unit forms a second toner image by an electric potential difference between the electric potential area and the developing roller. The charging bias applying unit decides a value of a charging bias corresponding to a target electric potential from measurement results of print densities of the first toner image and the second toner image.

8 Claims, 8 Drawing Sheets

IMAGE FORMING APPARATUS THAT ENSURES SETTING SURFACE POTENTIAL OF PHOTORECEPTOR DRUM WITH SIMPLE CONSTITUTION

INCORPORATION BY REFERENCE

This application is based upon, and claims the benefit of priority from, corresponding Japanese Patent Application No. 2015-193569 filed in the Japan Patent Office on Sep. 30, 2015, the entire contents of which are incorporated herein by reference.

BACKGROUND

Unless otherwise indicated herein, the description in this section is not prior art to the claims in this application and is not admitted to be prior art by inclusion in this section.

As a typical image forming apparatus employing an electrophotographic method such as a printer and a copier, there has been known an image forming apparatus that includes a photoreceptor drum, a charging apparatus, an exposure apparatus, a developing device, and a transfer apparatus. The charging apparatus uniformly charges a circumference surface of the photoreceptor drum. The exposure apparatus irradiates the photoreceptor drum with exposure light according to image information to form an electrostatic latent image. The developing device supplies the photoreceptor drum with toner to develop the electrostatic latent image into a toner image. The transfer apparatus transfers the toner image from the photoreceptor drum to a sheet.

To obtain good images, it is necessary that a surface potential of the photoreceptor drum in the image forming apparatus be set to be a desired electric potential. Especially, when the charging apparatus includes a charging roller that rotates while contacting a surface of the photoreceptor drum, even if a voltage applied to the charging roller is identical, the surface potential of the photoreceptor drum is likely to vary depending on an environmental variation or a similar factor. With the charging roller to which an ion conducting agent is combined, since a resistance value of the roller is likely to vary depending on the environment or a similar factor, a variation in displacement of the photoreceptor drum is likely to be especially remarkable.

There has been disclosed a typical image forming apparatus that includes a surface electrometer opposed to a circumference surface of a photoreceptor drum. Feeding back a measurement result of an electric potential by the surface electrometer to a voltage applied to a charging apparatus sets a surface potential of the photoreceptor drum to be a desired electric potential.

SUMMARY

An image forming apparatus according to one aspect of the disclosure includes an apparatus main body, a photoreceptor drum, a charging apparatus, a developing device, a transfer apparatus, a charging bias applying unit, a developing bias applying unit, a bias adjusting unit, and a print density measurement unit. The photoreceptor drum has a circumference surface on which an electrostatic latent image including a background portion and an image portion is formed. The photoreceptor drum is rotationally driven in a predetermined rotation direction. The charging apparatus is arranged in contact with or close to the circumference surface of the photoreceptor drum. The charging apparatus charges the circumference surface at a predetermined electric potential. The developing device includes a developing roller disposed opposed to the photoreceptor drum. The developing device supplies the photoreceptor drum with toner to develop the electrostatic latent image into a toner image. The transfer apparatus transfers the toner image from the photoreceptor drum to a sheet or an intermediate transfer belt. The charging bias applying unit applies a predetermined charging bias to the charging apparatus. The developing bias applying unit applies a predetermined developing bias to the developing roller. The bias adjusting unit performs a charging bias adjusting operation. The charging bias adjusting operation adjusts an electric potential at the background portion in the electrostatic latent image on the photoreceptor drum to a predetermined target electric potential. The print density measurement unit measures a print density of the toner image. The bias adjusting unit, in the charging bias adjusting operation, controls the charging bias applying unit to form a non-charged area, to which the charging bias is not applied, on the circumference surface of the photoreceptor drum, and controls the developing bias applying unit to apply the developing bias constituted of a first electric potential to the developing roller, so as to form a first toner image by an electric potential difference between the non-charged area and the developing roller. In the charging bias adjusting operation, the charging bias applying unit controls the charging bias applying unit to apply the charging bias found by subtracting the first electric potential from a first tentative charging bias preset corresponding to the target electric potential to form a predetermined electric potential area on the circumference surface of the photoreceptor drum, and controls the developing bias applying unit to apply the target electric potential to the developing roller, so as to form a second toner image by an electric potential difference between the electric potential area and the developing roller. The charging bias applying unit decides a value of the charging bias corresponding to the target electric potential from measurement results of print densities of the first toner image and the second toner image measured by the print density measurement unit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
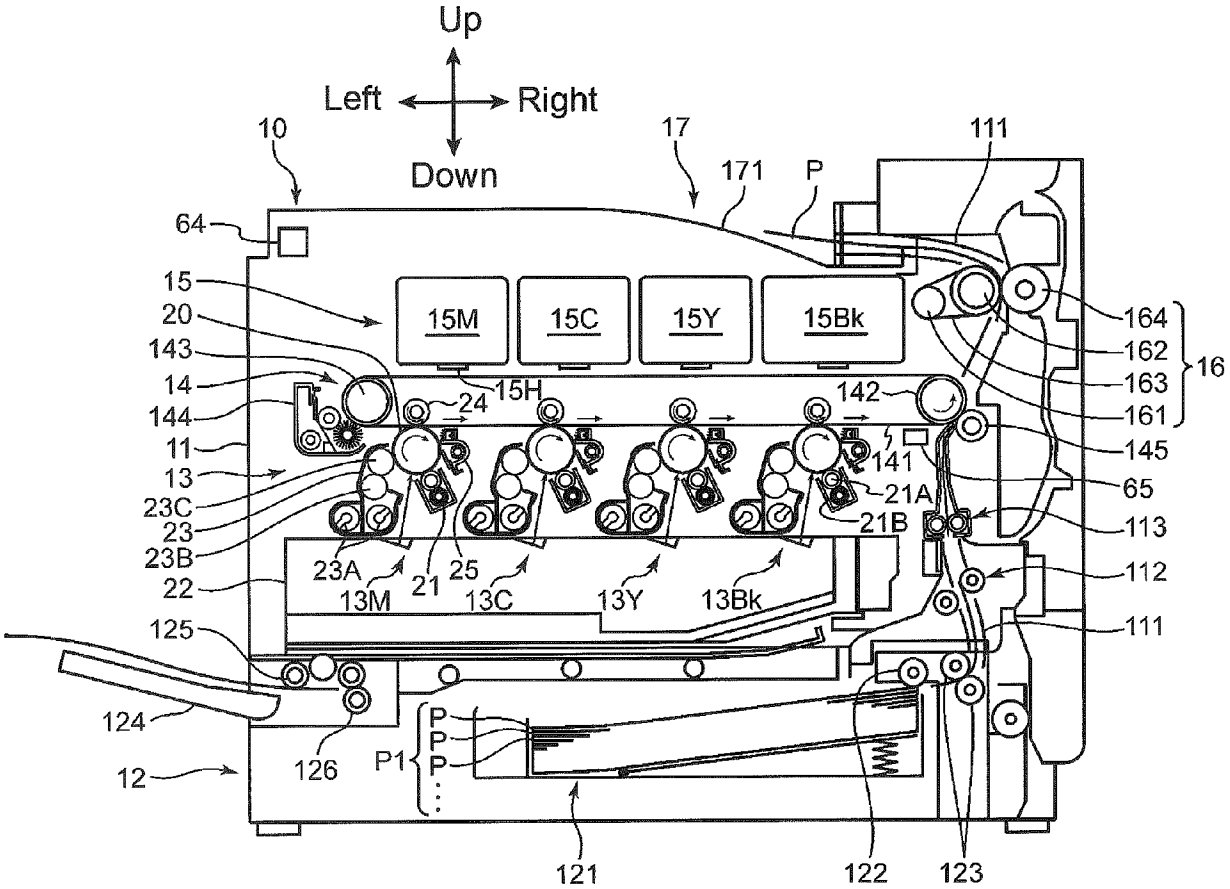
FIG. 1 illustrates a cross section of an internal structure of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus 10 according to embodiments of the disclosure in detail based on the accompanying drawings. This embodiment exemplifies a tandem type color printer as an exemplary image forming apparatus. The image forming apparatus may be devices such as a copier, a facsimile device, and a multifunctional peripheral of these devices.

FIG. 1 illustrates a cross section of an internal structure of the image forming apparatus 10. This image forming apparatus 10 includes an apparatus main body 11 with a box-shaped chassis structure. This apparatus main body 11 internally includes a paper sheet feeder 12, which feeds a sheet P, an image forming unit 13, which forms a toner image to be transferred to the sheet P fed from the paper sheet feeder 12, an intermediate transfer unit 14 on which the toner image is primarily transferred, a secondary transfer roller 145, a toner replenishment unit 15, which replenishes the image forming unit 13 with toner, and a fixing unit 16, which fixes an unfixed toner image formed on the sheet P to the sheet P. Furthermore, at the upper portion of the apparatus main body 11, a paper sheet discharge unit 17 to which the sheet P fixed by the fixing unit 16 is discharged is provided.

At an appropriate position on the top surface of the apparatus main body 11, an operation panel (not illustrated) for an input operation for an output condition to the sheet P or a similar operation is located. This operation panel includes a power key, a touch panel to input the output condition, and various operation keys. Additionally, the apparatus main body 11 internally includes a sheet conveyance path 111, which extends in a vertical direction, at a position right side of the image forming unit 13. The sheet conveyance path 111 includes a conveyance roller pair 112 to feed the sheet at an appropriate position. A registration roller pair 113 is arranged upstream with respect to a nip portion in the sheet conveyance path 111. The registration roller pair 113 performs skew correction on the sheet and sends out the sheet to the nip portion for a secondary transfer, which will be described later, at a predetermined timing. The sheet conveyance path 111 is a conveyance path that feeds the sheet P from the paper sheet feeder 12 to the paper sheet discharge unit 17 via the image forming unit 13 (the secondary transfer nip portion) and the fixing unit 16.

The paper sheet feeder 12 includes a sheet feed tray 121, a pickup roller 122, and a feed roller pair 123. The sheet feed tray 121 is insertably/removably mounted to a lower position of the apparatus main body 11 to accumulate a sheet bundle P1, which is a plurality of the stacked sheets P. The pickup roller 122 feeds out the sheet P on the uppermost surface of the sheet bundle P1 accumulated at the sheet feed tray 121 one by one. The feed roller pair 123 sends out the sheet P fed out by the pickup roller 122 to the sheet conveyance path 111. The paper sheet feeder 12 includes a manual paper feed tray, which is mounted to a left side surface of the apparatus main body 11 illustrated in FIG. 1. The manual paper feed tray includes a bypass tray 124, a pickup roller 125, and a feed roller pair 126. The bypass tray 124 is a tray on which the sheet P is manually placed. When the sheet P is manually fed, as illustrated in FIG. 1, the bypass tray 124 is opened from the side surface of the apparatus main body 11. The pickup roller 125 feeds out the sheet P placed on the bypass tray 124. The feed roller pair 126 sends out the sheet P fed out by the pickup roller 125 to the sheet conveyance path 111.

The image forming unit 13 forms a toner image to be transferred to the sheet P. The image forming unit 13 includes a plurality of image forming units, which form toner images of different colors. As this image forming unit, this embodiment includes a magenta unit 13M, which uses a magenta (M) color developer, a cyan unit 13C, which uses a cyan (C) color developer, a yellow unit 13Y, which uses a yellow (Y) color developer, and a black unit 13Bk, which uses a black (Bk) color developer, sequentially from upstream to downstream in a rotation direction of an intermediate transfer belt 141 (from the left side to the right side shown in FIG. 1). The image forming units 13M, 13C, 13Y, and 13Bk each include a photoreceptor drum 20 (an image carrier), a charging apparatus 21, which is arranged at a peripheral area of the photoreceptor drum 20, a developing device 23, and a cleaning apparatus 25. An exposure apparatus 22 shared by the respective image forming units 13M, 13C, 13Y, and 13Bk is arranged below these image forming units.

The photoreceptor drum 20 is rotatably driven in a direction of the arrow in FIG. 1 (a predetermined rotation direction) around the axis, and an electrostatic latent image and a toner image are formed on a circumference surface of the photoreceptor drum 20. The electrostatic latent image formed on the photoreceptor drum 20 includes a background portion and an image portion according to image information. A rotation shaft of the photoreceptor drum 20 extends in a front-rear direction (a direction perpendicular to the paper surface of FIG. 1). As this photoreceptor drum 20, a photoreceptor drum using an organic photo conductor (OPC) based material is applicable. As illustrated in FIG. 1, a plurality of the photoreceptor drums 20 corresponding to the respective colors are arranged at predetermined intervals in a lateral direction (a horizontal direction).

The charging apparatus 21 uniformly charges the circumference surface of the photoreceptor drum 20 at a predetermined electric potential. As the charging apparatus 21, a charging apparatus with a contact electrification method can be employed. The charging apparatus 21 includes a charging roller 21A, which contacts the circumference surface of the photoreceptor drum 20 and is arranged and rotationally driven, and a charging cleaning brush 21B to remove toner attached to the charging roller 21A. In another embodiment, the charging roller 21A may close the circumference surface of the photoreceptor drum 20. The exposure apparatus 22 includes various optical system devices such as a light source, a polygon mirror, a reflection mirror, and a deflecting mirror. The exposure apparatus 22 irradiates the uniformly charged circumference surface of the photoreceptor drum 20 with light modulated based on image data to form the above-described electrostatic latent image. The cleaning apparatus 25 cleans the circumference surface of the photoreceptor drum 20 after toner image transfer.

The developing device 23 supplies the circumference surface of the photoreceptor drum 20 with toner to develop the electrostatic latent image formed on the photoreceptor drum 20. The developing device 23 is for two-component developer constituted of toner and a carrier. The developing device 23 supplies the toner to the circumference surface of the photoreceptor drum 20 to develop the electrostatic latent image. The developing device 23 includes a developing roller 23C opposed to the photoreceptor drum 20, a magnetic roller 23B, and a pair of screws 23A. As the developing device 23, another constitution including the developing roller 23C may be applied. In this embodiment, the toner has a property that charges to a positive polarity.

The intermediate transfer unit 14 is located at the space between the image forming unit 13 and the toner replenishment unit 15. The intermediate transfer unit 14 includes the intermediate transfer belt 141, a drive roller 142, a tension roller 143, a plurality of primary transfer rollers 24 (transfer rollers), and a belt cleaning apparatus 144.

The intermediate transfer belt 141 is an endless belt-shaped rotator and is suspended across the drive roller 142 and the tension roller 143 such that its circumference surface side is brought into contact with the circumference surfaces of the respective photoreceptor drums 20. The intermediate transfer belt 141 is circularly driven in one direction along the lateral direction, and carries the toner image transferred from a plurality of the photoreceptor drums 20 on its surface. The intermediate transfer belt 141 is a conductive soft belt with a laminated structure formed of a base layer, an elastic layer, and a coat layer.

The drive roller 142 stretches the intermediate transfer belt 141 at a right end side of the intermediate transfer unit 14, and causes the intermediate transfer belt 141 to circularly drive. The drive roller 142 is constituted of a metal roller. The tension roller 143 passively rotates at a left end side of the intermediate transfer unit 14. The tension roller 143 stretches the intermediate transfer belt 141. The tension roller 143 provides the intermediate transfer belt 141 with a tensile strength. The belt cleaning apparatus 144 (see FIG. 1), which is located at the proximity of the tension roller 143, removes a remnant toner on the circumference surface of the intermediate transfer belt 141.

The primary transfer roller 24 is located across the intermediate transfer belt 141, and opposed to the photoreceptor drum 20. This forms primary transfer nip portions between the primary transfer rollers 24 and the photoreceptor drums 20 to primarily transfer the toner image, which is on the photoreceptor drum 20, on the intermediate transfer belt 141. As illustrated in FIG. 1, respective primary transfer rollers 24 are opposed to the photoreceptor drums 20 for the respective colors. The primary transfer roller 24 is a roller extending in the front-rear direction, and rotationally driven along with the intermediate transfer belt 141.

The secondary transfer roller 145 is opposed to the drive roller 142 across the intermediate transfer belt 141. The secondary transfer roller 145 is pressed and contacts the circumference surface of the intermediate transfer belt 141 to form a secondary transfer nip portion. The toner image primarily transferred on the intermediate transfer belt 141 is secondarily transferred on the sheet P supplied from the paper sheet feeder 12 at the secondary transfer nip portion. In this embodiment, the intermediate transfer unit 14 and the secondary transfer roller 145 constitute a transfer apparatus. The transfer apparatus transfers the toner image from the photoreceptor drum 20 to the sheet P.

The toner replenishment unit 15 retains toners used for an image formation. The toner replenishment unit 15 according to the embodiment includes a magenta toner container 15M, a cyan toner container 15C, a yellow toner container 15Y, and a black toner container 15Bk. These toner containers 15M, 15C, 15Y, and 15Bk retain respective replenishment toners for the respective colors M, C, Y, and Bk. The toner containers 15M, 15C, 15Y, and 15Bk replenish the toners for the respective colors to the developing devices 23 for the image forming units 13M, 13C, 13Y, and 13Bk, which correspond to the respective colors M, C, Y, and Bk, from toner discharge ports 15H, which are formed on the bottom surfaces of the containers, via a toner conveying unit (not illustrated).

The fixing unit 16 includes a heating roller 161, which internally includes a heat source, a fixing roller 162, which is located opposed to the heating roller 161, a fixing belt 163, which is stretched between the fixing roller 162 and heating roller 161, and a pressure roller 164, which is opposed to the fixing roller 162 via the fixing belt 163 and forms a fixing nip portion. The sheet P supplied to the fixing unit 16 passes through the fixing nip portion to be heated and pressurized. This fixes the toner image, which has been transferred to the sheet P at the secondary transfer nip portion, to the sheet P.

The paper sheet discharge unit 17 is formed by depressing the top of the apparatus main body 11. The bottom portion of this concave portion forms a sheet discharge tray 171 that receives the discharged sheet P. The sheet P on which the fixing process has been performed is discharged to a sheet discharge tray 171 via the sheet conveyance path 111 running from the upper portion of the fixing unit 16.

Figure 2:
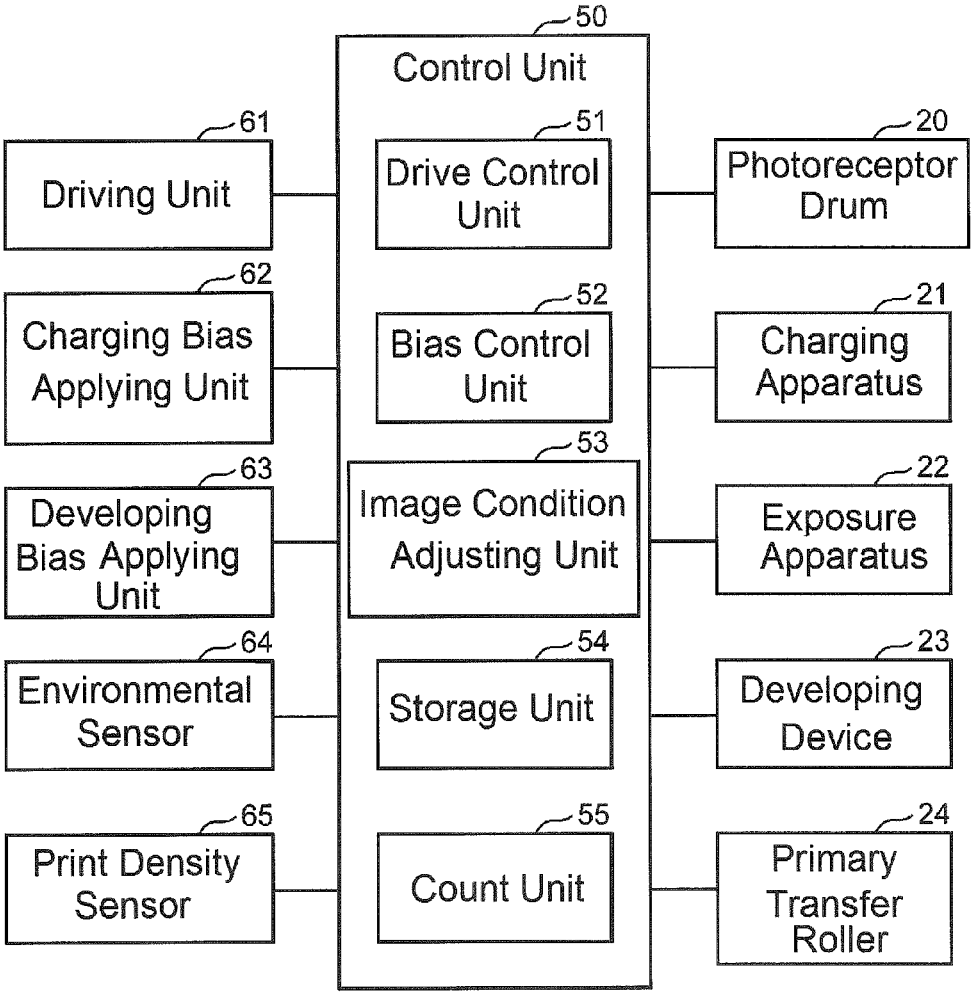
FIG. 2 illustrates an electrical block diagram of a control unit of the image forming apparatus according to the embodiment of the disclosure.

FIG. 2 illustrates an electrical block diagram of a control unit 50 of the image forming apparatus 10 according to the embodiment. The image forming apparatus 10 includes the control unit 50, which integrally controls the respective operations of this image forming apparatus 10. The control unit 50 is constituted of a Central Processing Unit (CPU), a Read Only Memory (ROM), which stores control programs, a Random Access Memory (RAM), which is used as a work area for the CPU, and a similar member. In addition to the above-described photoreceptor drum 20, charging apparatus 21, exposure apparatus 22, developing device 23, and primary transfer roller 24 of the image forming unit 13 and a similar member, to the control unit 50, a driving unit 61, a charging bias applying unit 62, a developing bias applying unit 63, an environmental sensor 64 (an environment detector), a print density sensor 65 (a print density measurement unit), and a similar member are electrically connected.

The driving unit 61 is formed of a gear mechanism that transmits a motor and a torque of the motor. The driving unit 61 rotates the respective members such as the image forming unit 13 and the secondary transfer roller 145 according to a control signal from a drive control unit 51, which will be described later.

The charging bias applying unit 62 is constituted of a DC power supply. Based on a control signal from a bias control unit 52, which will be described later, the charging bias applying unit 62 applies a predetermined charging bias to the charging roller 21A of the charging apparatus 21.

The developing bias applying unit 63 is constituted of a DC power supply and an AC power supply. Based on the control signal from the bias control unit 52, the developing bias applying unit 63 applies a predetermined developing bias to the developing roller 23C and the magnetic roller 23B of the developing device 23.

The environmental sensor 64 (see FIG. 1) is provided with the apparatus main body 11. The environmental sensor 64 detects temperature and humidity inside the apparatus main body 11. In another embodiment, the environmental sensor 64 may detect the temperature and humidity around the apparatus main body 11.

The print density sensor 65 (see FIG. 1) detects an image density of the toner image formed on the intermediate transfer belt 141 and converts the image density into an electric signal. The print density sensor 65 includes a light-emitting element, which emits light on a belt surface of the rotatably driven intermediate transfer belt 141, and a light receiving portion (not illustrated), which receives a reflected light from this belt surface. An image condition adjusting unit 53, which will be described later, refers to information on the image density output from the print density sensor 65, and the information is reflected to a charging bias adjusting operation, which will be described later.

An execution of the control program stored in the ROM by the CPU causes the control unit 50 to function as the drive control unit 51, the bias control unit 52, the image condition adjusting unit 53, a storage unit 54, and a count unit 55.

The drive control unit 51 controls the driving unit 61 according to an image forming operation by the image forming apparatus 10 and the charging bias adjusting operation, which will be described later. The drive control unit 51 controls a driving mechanism (not illustrated) as well as the driving unit 61 to drive other driving members in the image forming apparatus 10.

Similarly, the bias control unit 52 controls the charging bias applying unit 62 and the developing bias applying unit 63 according to the image forming operation by the image forming apparatus 10, the charging bias adjusting operation, and a calibration operation. The bias control unit 52 controls a bias applying unit (not illustrated) as well as the charging bias applying unit 62 and the developing bias applying unit 63 to apply a predetermined bias to other members inside the image forming apparatus 10. As one example, the bias control unit 52 applies a primary transfer bias and a secondary transfer bias to the primary transfer roller 24 and the secondary transfer roller 145, respectively.

The image condition adjusting unit 53 executes various image condition adjusting operations in the image forming apparatus 10. This image condition adjusting operation includes the charging bias adjusting operation. In the charging bias adjusting operation, the image condition adjusting unit 53 adjusts an electric potential at the background portion in the electrostatic latent image on the photoreceptor drum 20 to a predetermined target electric potential.

The storage unit 54 stores various pieces of reference information referred to by the drive control unit 51, the bias control unit 52, and the image condition adjusting unit 53. As one example, the storage unit 54 stores electric potential information referred to in the charging bias adjusting operation.

The count unit 55 counts various pieces of accumulated information in the image forming operation by the image forming apparatus 10 and the image condition adjusting operation. As one example, the count unit 55 counts the number of printed sheets to which the toner image is transferred, a printing interval period of the sheets (a period during which the image forming apparatus 10 is left), the number of accumulated rotations of the photoreceptor drum 20, and an accumulated application period of the charging bias by the charging apparatus 21.

Charging Bias Adjusting Operation

Figure 3:
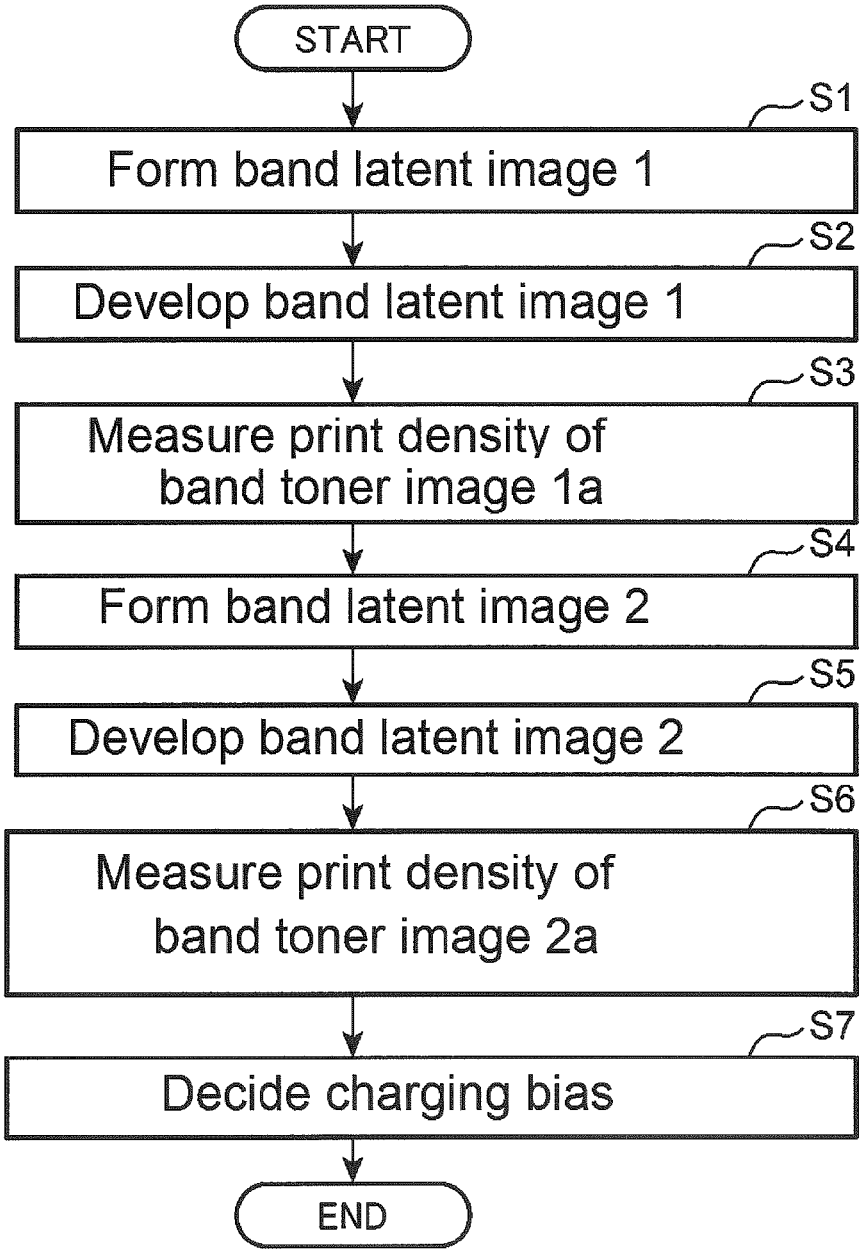
FIG. 3 illustrates a charging bias adjusting operation according to a first embodiment of the disclosure.
Figure 4:
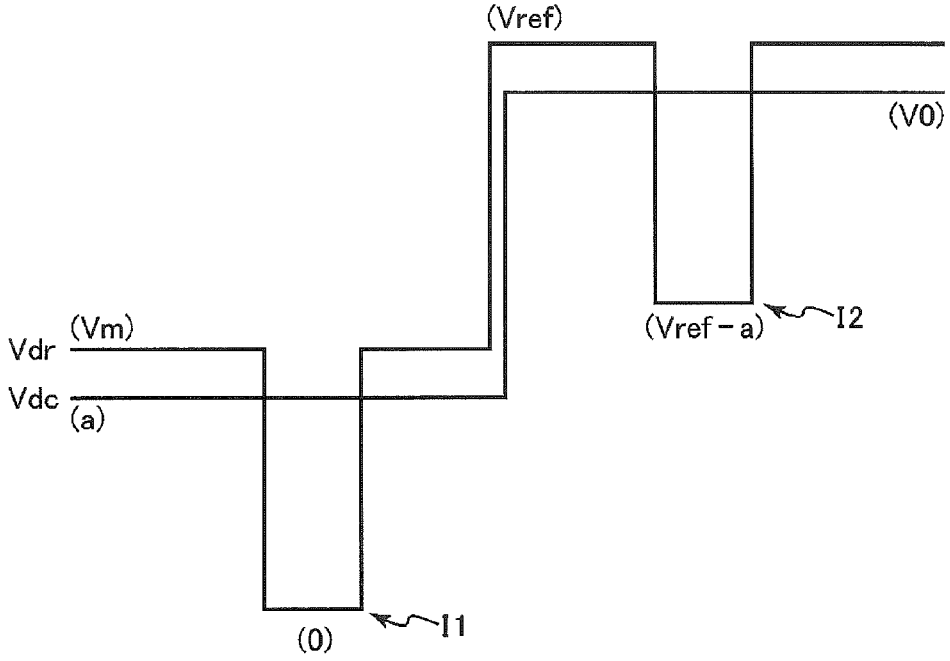
FIG. 4 schematically illustrates an electric potential relationship in the charging bias adjusting operation according to the first embodiment.

The following describes the charging bias adjusting operation according to a first embodiment of the disclosure. FIG. 3 illustrates the charging bias adjusting operation according to the embodiment. FIG. 4 schematically illustrates an electric potential relationship between the photoreceptor drum 20 and the developing roller 23C in the charging bias adjusting operation according to the embodiment. FIG. 4 indicates a surface potential of the photoreceptor drum 20 as Vdr and an electric potential of a DC bias of the developing roller 23C as Vdc. As described above, this embodiment includes the charging roller 21A, which contacts with the circumference surface of the photoreceptor drum 20 and rotates. Especially in this embodiment, an ion conducting agent is combined in the charging roller 21A. Since a resistance value of such ion-conductive charging roller 21A has a property that is likely to change depending on an environmental condition such as a temperature and a humidity, it is difficult to hold the surface potential of the photoreceptor drum 20 constant. In such case, arranging a well-known surface electrometer opposed to the circumference surface of the photoreceptor drum 20 ensures performing a feedback control on the charging bias applied to the charging roller 21A based on a measurement result by the surface electrometer. However, this causes a problem of cost increase in the image forming apparatus 10. To solve such problem, this embodiment does not include an electrometer, which measures the surface potential of the photoreceptor drum 20, but the image condition adjusting unit 53 performs the charging bias adjusting operation to accurately set the surface potential of the photoreceptor drum 20 to a target electric potential. This embodiment performs the charging bias adjusting operation in order on the photoreceptor drums 20 for the respective colors. In another embodiment, the charging bias adjusting operation may be concurrently performed on the photoreceptor drums 20 for a plurality of colors.

With reference to FIG. 3, the charging bias adjusting operation includes seven steps, a formation of a band latent image 1 (Step S1), a development of the band latent image 1 (Step S2), a measurement of a print density of a band toner image 1*a* (Step S3), a formation of a band latent image 2 (Step S4), a development of the band latent image 2 (Step S5), a measurement of a print density of the band toner image 2*a* (Step S6), and a decision of a charging bias (Step S7). Roughly dividing the charging bias adjusting operation, the charging bias adjusting operation is classified into a first phase until the measurement of the print density of the band toner image 1*a* (Step S3), a second phase until the measurement of the print density of the band toner image 2*a* (Step S6), and a third phase of the decision of the charging bias (Step S7). A timing that the charging bias adjusting operation is performed will be described later in detail.

The execution of the charging bias adjusting operation forms the band latent image 1 in FIG. 4 by the image condition adjusting unit 53 (Step S1). To form a good image by the image forming apparatus 10, a preset target electric potential at the background portion of the photoreceptor drum 20 is defined as V0 (V). As described above, this embodiment does not directly measure the surface potential of the photoreceptor drum 20 by, for example, the electrometer. On the other hand, by controlling an input signal input from the bias control unit 52 to the charging bias applying unit 62, it is possible to control a value of the charging bias applied to the charging roller 21A by the charging bias applying unit 62 within a predetermined error range. In view of this, the charging bias adjusting operation leads the value of the charging bias such that the surface potential of the photoreceptor drum 20 becomes V0 (V). The storage unit 54 (see FIG. 2) preliminary stores a value of a charging bias Vref. The charging bias Vref is a value preliminary derived experimentally such that the surface potential of the photoreceptor drum 20 becomes V0 (V). Even if this charging bias Vref is applied to the charging roller 21A of the charging apparatus 21, the surface potential of the photoreceptor drum 20 is not always set to V0 (V). Therefore, the above-described charging bias adjusting operation is required.

At Step S1, the image condition adjusting unit 53 refers to an intermediate charging bias Vm preliminary stored in the storage unit 54 (see FIG. 2) and controls the charging bias applying unit 62 to apply this intermediate charging bias Vm. The intermediate charging bias Vm is a bias value whose absolute value is smaller than the charging bias Vref. Consequently, the surface of the photoreceptor drum 20 is charged to the intermediate electric potential (Vm). This intermediate electric potential can be set providing a certain degree of freedom. When a two-component development method is used as a development method, an excessively high intermediate electric potential is likely to generate a carrier development due to an electric potential difference between the surface potential Vdr of the photoreceptor drum 20 and the electric potential Vdc of the developing roller 23C. Accordingly, the intermediate electric potential of the photoreceptor drum 20 is preferably a value before and after 50% of the target electric potential V0. When the two-component development method is not used as the development method, similar to Step S4, which will be described later, the photoreceptor drum 20 may be charged with the charging bias Vref.

If the surface potential Vdr at the background portion of the photoreceptor drum 20 is lower than the developing bias Vdc, a background portion fog occurs. This is likely to generate an error in the print density measurement at Step S3, which will be described later. In view of this, the surface potential Vdr at the background portion of the photoreceptor drum 20 at Step S1 is preferably higher than the developing bias Vdc. Next, the image condition adjusting unit 53 controls the charging bias applying unit 62 to form a charging bias 0 V (charging bias: OFF) area by a predetermined period. Consequently, as illustrated in FIG. 4, on the circumference surface of the photoreceptor drum 20, a non-charged area where the surface potential is approximately 0 V is formed. As will be described later, adjusting the values of the developing bias applied to the developing roller 23C and the transfer bias applied to the primary transfer roller 24 at a good timing ensures further making the surface potential of the photoreceptor drum 20 in the non-charged area close to 0 V.

At Step S2, the band latent image 1 is developed. The image condition adjusting unit 53 sets the developing bias Vdc applied to the developing roller 23C to a preset electric potential a (V) to develop the latent image (the band latent image 1, the non-charged area), which is formed at Step S1. Consequently, the electric potential difference between the developing roller 23C to which the developing bias Vdc at a (V) has been applied and the non-charged area forms the band toner image 1*a* (see I1 in FIG. 4) on the circumference surface of the photoreceptor drum 20. This embodiment sets a=100 V, and this a value is also preliminary stored in the storage unit 54. The a value is preferably in a range of 50 to 200 V and 100 to 150 V is more preferable.

At Step S3, the print density of the band toner image 1*a* formed at Step S2 is measured. The toner image on the photoreceptor drum 20 is transferred to the intermediate transfer belt 141 at a predetermined primary transfer bias applied to the primary transfer roller 24. The toner image carried on the intermediate transfer belt 141 passes through immediately above the print density sensor 65 in FIG. 1. In this respect, the print density sensor 65 measures the print density of the toner image. The storage unit 54 (see FIG. 2) stores the print density result of the respective toner images measured by the print density sensor 65.

At Step S4, the band latent image 2 is formed. Here, the image condition adjusting unit 53 controls the charging bias applying unit 62 to apply the charging bias Vref to the charging roller 21A. At this phase, the surface potential of the photoreceptor drum 20 is possibly set to a value shifted from the target electric potential V0. Further, the image condition adjusting unit 53 controls the charging bias applying unit 62 and causes the charging bias applying unit 62 to apply a value found by subtracting the above-described a (V) from the charging bias Vref by the predetermined period. Consequently, as illustrated in FIG. 4, the band latent image 2 (the electric potential area) is formed on the circumference surface of the photoreceptor drum 20.

At Step S5, the band latent image 2 is developed. The image condition adjusting unit 53 sets the developing bias Vdc applied to the developing roller 23C to the target electric potential V0 (V) of the photoreceptor drum 20 and develops the latent image (the band latent image 2) formed at Step S4. Consequently, the electric potential difference between the developing roller 23C to which the developing bias Vdc at V0 (V) has been applied and the band latent image 2 forms the band toner image 2*a* (see 12 in FIG. 4) on the circumference surface of the photoreceptor drum 20.

At Step S6, the image condition adjusting unit 53 controls the print density sensor 65 to measure the print density of the band toner image 2*a* formed at Step S5.

At Step S7, a print density D1 of the band toner image 1*a* measured at Step S3 is compared with a print density D2 of the band toner image 2*a* measured at Step S6 and corrects the charging bias Vref as necessary. As described above, when the electric potential at the non-charged area, which is formed at Step S1, is 0 (V), the print density D1 of the band toner image 1*a* is formed through movement of the toner caused by the electric potential difference a (V) between the photoreceptor drum 20 and the developing roller 23C. At Step S4, assuming that, the application of the charging bias Vref sets the surface potential Vdr of the photoreceptor drum 20 to the target electric potential V0 (V), the surface potential Vdr at the background portion of the photoreceptor drum 20 becomes identical to the electric potential of the developing roller 23C. In view of this, since the movement of the toner caused by the electric potential difference a (v) forms the print density D2 of the band toner image 2*a*, print density D1=print density D2.

On the other hand, the print density D2 measured at Step S6 is larger than the print density D1, the surface potential Vdr at the background portion of the photoreceptor drum 20 at Step S4 is smaller than the target electric potential V0. Accordingly, in this case, the image condition adjusting unit 53 decides a value larger than the charging bias Vref as a charging bias with respect to the target electric potential V0 (V). In details, the application of the charging bias found by adding a preset increment value m (V) to the charging bias Vref to the photoreceptor drum 20 executes Steps S4 to S6 again. Thus, while correcting the value of the charging bias applied to the charging roller 21A, the image condition adjusting unit 53 extracts the charging bias so as to meet the print density D1=print density D2. When the print density D2 measured at Step S6 is smaller than the print density D1, the image condition adjusting unit 53 decides a value smaller than the charging bias Vref as a charging bias with respect to the target electric potential V0 (V). Thus, the value of the charging bias corresponding to the target electric potential V0 for the photoreceptor drum 20 is decided.

As described above, in this embodiment, the image condition adjusting unit 53 controls the charging bias applying unit 62 in the charging bias adjusting operation to form the non-charged area to which the charging bias is not applied on the circumference surface of the photoreceptor drum 20. The image condition adjusting unit 53 controls the developing bias applying unit 63 to apply the developing bias Vdc constituted of a (V) (a first electric potential) to the developing roller 23C, thus forming the band toner image 1*a* (a first toner image) by the electric potential difference between the non-charged area and the developing roller 23C. Further, the image condition adjusting unit 53 controls the charging bias applying unit 62 to apply a charging bias found by subtracting a (V) from the charging bias Vref (a first tentative charging bias), which is preset corresponding to the target electric potential V0 (V), on the circumference surface of the photoreceptor drum 20 to form the band latent image 2 (a predetermined electric potential area). The image condition adjusting unit 53 controls the developing bias applying unit 63 to apply the target electric potential V0 (V) to the developing roller 23C, thus forming the band toner image 2*a* (a second toner image) by the electric potential difference between the band latent image 2 and developing roller 23C. The image condition adjusting unit 53 decides the value of the charging bias corresponding to the target electric potential V0 from the results of print density measurements of the band toner image 1*a* and the band toner image 2*a* measured by the print density sensor 65 (D1 and D2). Accordingly, based on a relationship between the charging bias at the band toner image 1*a* and the print density of the toner image, an amount of discrepancy of the charging bias Vref with respect to the target electric potential V0 is decidable. This ensures setting the surface potential of the photoreceptor drum 20 to the target electric potential with a simple configuration without providing a surface electrometer opposed to the photoreceptor drum 20.

Especially, with the print density of the band toner image 1*a* higher than the print density of the band toner image 2*a* in the charging bias adjusting operation, the image condition adjusting unit 53 decides a value smaller than the charging bias Vref as the charging bias corresponding to the target electric potential V0. With the print density of the band toner image 1*a* lower than the print density of the band toner image 2*a*, the image condition adjusting unit 53 decides a value larger than the charging bias Vref as the charging bias corresponding to the target electric potential V0. In view of this, from the comparison result of print density between the band toner image 1*a* and the band toner image 2*a*, the charging bias corresponding to the target electric potential V0 can be easily decided.

In this embodiment, the image condition adjusting unit 53 controls the charging bias applying unit 62 in the charging bias adjusting operation to apply a predetermined intermediate charging bias Vm, thus setting a background portion electric potential before and after the rotation direction of the non-charged area (0 V). The intermediate charging bias Vm is set smaller than the target electric potential V0. In view of this, even if the developing device uses a two-component developer, this restrains the movement of a large amount of carrier from the developing roller 23C to the photoreceptor drum 20 during the charging bias adjusting operation.

Figure 5:
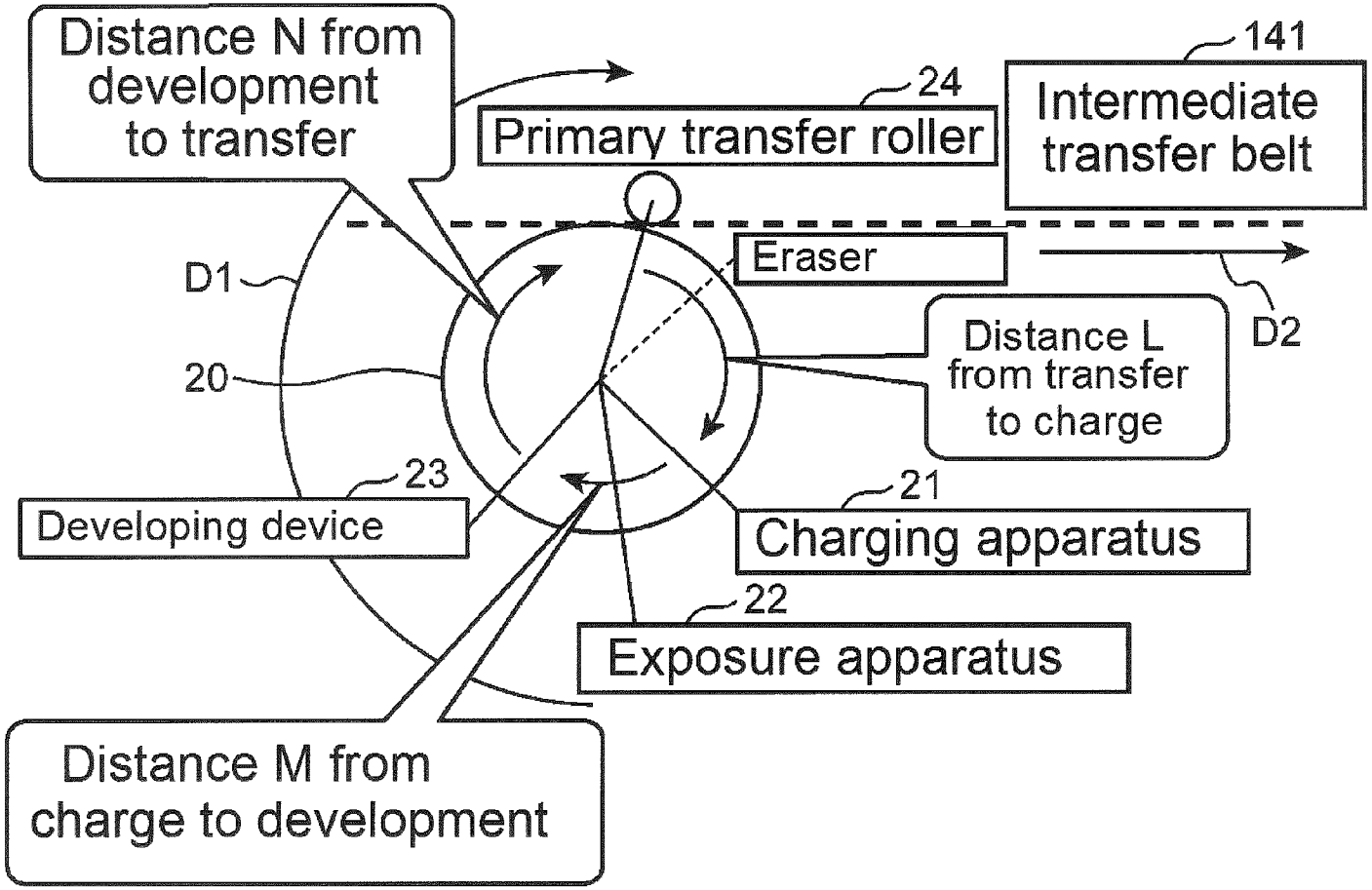
FIG. 5 schematically describes a timing of the charging bias adjusting operation according to the first embodiment.
Figure 6:
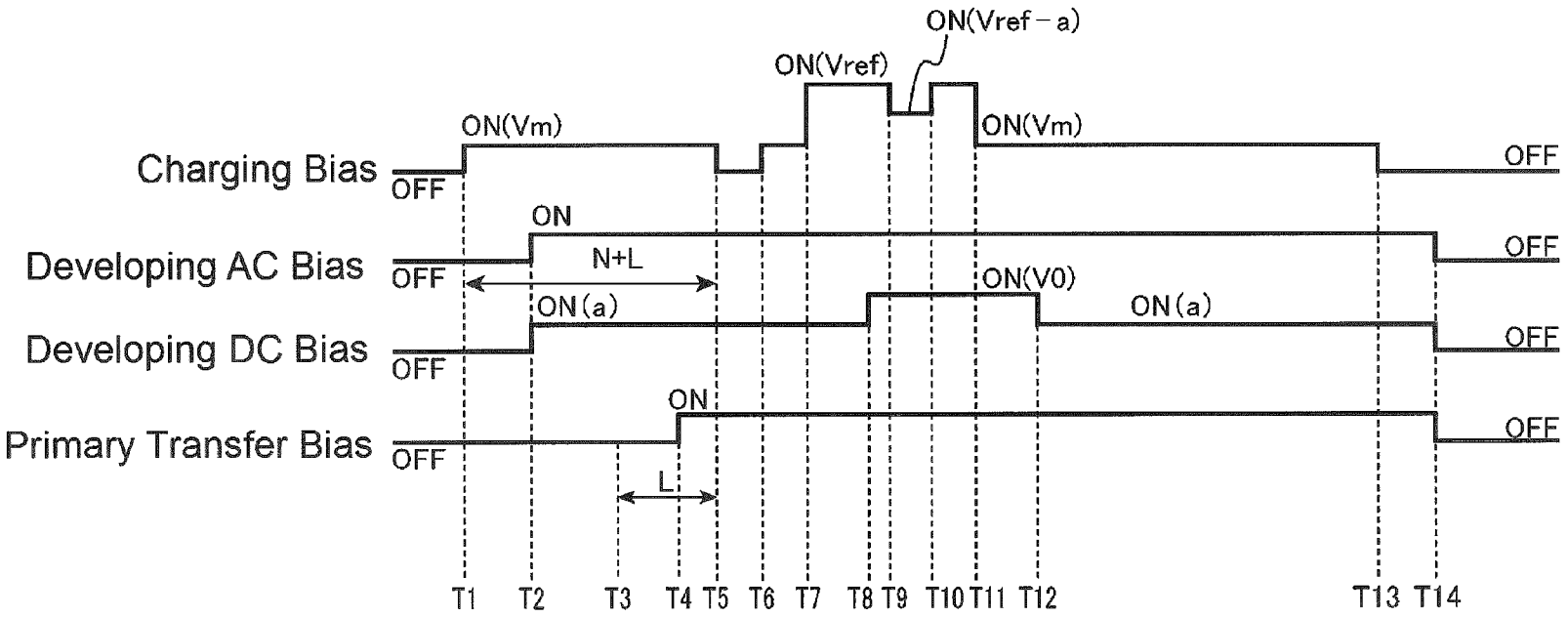
FIG. 6 illustrates the timing of the charging bias adjusting operation according to the first embodiment.

Next, the following describes a timing control of the charging bias adjusting operation according to the embodiment. FIG. 5 is a schematic view describing the timing of the charging bias adjusting operation according to the embodiment. FIG. 6 illustrates the timing of the charging bias adjusting operation according to the embodiment.

FIG. 5 schematically illustrates a disposition of an eraser (a static eliminator), which is not illustrated in FIG. 1, at the peripheral area of the photoreceptor drum 20 in addition to the charging apparatus 21, the exposure apparatus 22, the developing device 23, and the primary transfer roller 24. In FIG. 5, the photoreceptor drum 20 is rotationally driven in an arrow D1 direction. The intermediate transfer belt 141, which is sandwiched between the photoreceptor drum 20 and the primary transfer roller 24, circles around in an arrow D2 direction. With reference to FIG. 5, a distance on the circumference surface of the photoreceptor drum 20 from a position at which the primary transfer roller 24 is opposed to the photoreceptor drum 20 (a position at which a straight line connecting a shaft center of the primary transfer roller 24 and a shaft center of the photoreceptor drum 20 intersects with the circumference surface of the photoreceptor drum 20) to a position at which the charging apparatus 21 is opposed to the photoreceptor drum 20 (a position at which a straight line connecting a shaft center of the charging roller 21A and the shaft center of the photoreceptor drum 20 intersects with the circumference surface of the photoreceptor drum 20) is defined as L. Similarly, a distance on the circumference surface of the photoreceptor drum 20 from a position at which the charging apparatus 21 is opposed to the photoreceptor drum 20 to a position at which the developing device 23 is opposed to the photoreceptor drum 20 (a position at which a straight line connecting a shaft center of the developing roller 23C and the shaft center of the photoreceptor drum 20 intersects with the circumference surface of the photoreceptor drum 20) is defined as M. Further, a distance on the circumference surface of the photoreceptor drum 20 from a position at which the developing device 23 is opposed to the photoreceptor drum 20 to a position at which the primary transfer roller 24 is opposed to the photoreceptor drum 20 is defined as N. As one example, this embodiment sets the distance L=28.4 mm, the distance M=15 mm, and the distance N=32 mm.

In FIG. 6 the charging bias adjusting operation according to the embodiment is performed from a time T1 to a time T14. FIG. 6 illustrates ON/OFF timings of the charging bias, which is applied to the charging roller 21A, an AC bias and a DC bias of the developing bias, which are applied to the developing roller 23C, and the primary transfer bias (the transfer bias), which is applied to the primary transfer roller 24. With reference to the timings of the charging bias in FIG. 6, the time T1 to a time T7 correspond to Step S1 in FIG. 3, and the time T7 to a time T11 correspond to Step S4 in FIG. 3.

At Step S1 in FIG. 3, to set the surface potential of the photoreceptor drum 20 at the non-charged area closer to 0 (V), this embodiment preferably controls the application timing of the AC bias of the developing bias applied to the developing roller 23C and the application timing of the primary transfer bias applied to the primary transfer roller 24. That is, by turning off the charging bias from a time T5 to a time T6 forms the above-described non-charged area. Prior to this, the AC bias of the developing bias is not preliminarily applied to the circumference surface of the photoreceptor drum 20 corresponding to the non-charged area (from the time T1 to a time T2). In this respect, a phase of the application timing of the developing bias is controlled so as to be shifted by the above-described distance N+L. Various waveforms are applicable to an AC waveform of the developing bias; however, a sine waveform or a rectangular waveform is preferable. To restrain a leakage between the photoreceptor drum 20 and the developing roller 23C and a variation in print density, an amplitude of an AC waveform (a voltage between peaks) Vpp is preferably 500 to 1500 (V). Developing the band toner image 1*a* and the band toner image 2*a* while the AC bias of the developing bias is kept to be applied secures stable print density of the toner image (from the time T2 to the time T14).

Similarly, with reference to FIG. 6, the primary transfer bias is not preliminarily applied to the circumference surface of the photoreceptor drum 20 corresponding to the non-charged area (from a time T3 to a time T4). In this respect, the phase of the application timing of the primary transfer bias is controlled so as to be shifted by the above-described distance L.

An influence that the DC bias of the developing bias gives the electric potential (0 V) at the non-charged area is little; however, as illustrated in FIG. 6, this embodiment controls the DC bias and the AC bias of the developing bias to synchronously turn ON at the time T2. In FIG. 6, from a time T8 to a time T12, the target electric potential V0 of the photoreceptor drum 20 is applied to the developing roller 23C. The ON/OFF state of the charging bias and the developing bias are controlled to shift the phases by the time T2–the time T1, accommodating the distance between the charging apparatus 21 and the developing device 23.

Thus, in this embodiment, the image forming apparatus 10 includes a transfer bias applying unit (not illustrated), which applies a predetermined transfer bias to the primary transfer roller 24. In the charging bias adjusting operation, the image condition adjusting unit 53 stops the primary transfer bias before an area corresponding to the non-charged area in the circumference surface of the photoreceptor drum 20 passing through the charging apparatus 21 and when passing through the primary transfer roller 24. This ensures setting the non-charged area closer to 0 V, thereby ensuring accurately deciding the charging bias corresponding to the target electric potential V0.

The developing bias applying unit 63 applies the developing bias configured by superimposing the AC bias to the DC bias to the developing roller 23C. In the charging bias adjusting operation, the image condition adjusting unit 53 at least stops the AC bias of the developing bias before the area corresponding to the non-charged area in the circumference surface of the photoreceptor drum 20 passing through the charging apparatus 21 and when passing through the developing device 23. This ensures setting the non-charged area closer to 0 V, thereby ensuring accurately deciding the charging bias corresponding to the target electric potential V0. In another embodiment, only one of the developing bias and the primary transfer bias may be stopped. Further, in another embodiment, the non-charged area may be formed only the application of the charging bias is stopped by the charging apparatus 21. That is, corresponding to the non-charged area, the AC bias of the developing bias and the primary transfer bias may not necessarily to be stopped.

Figure 7:
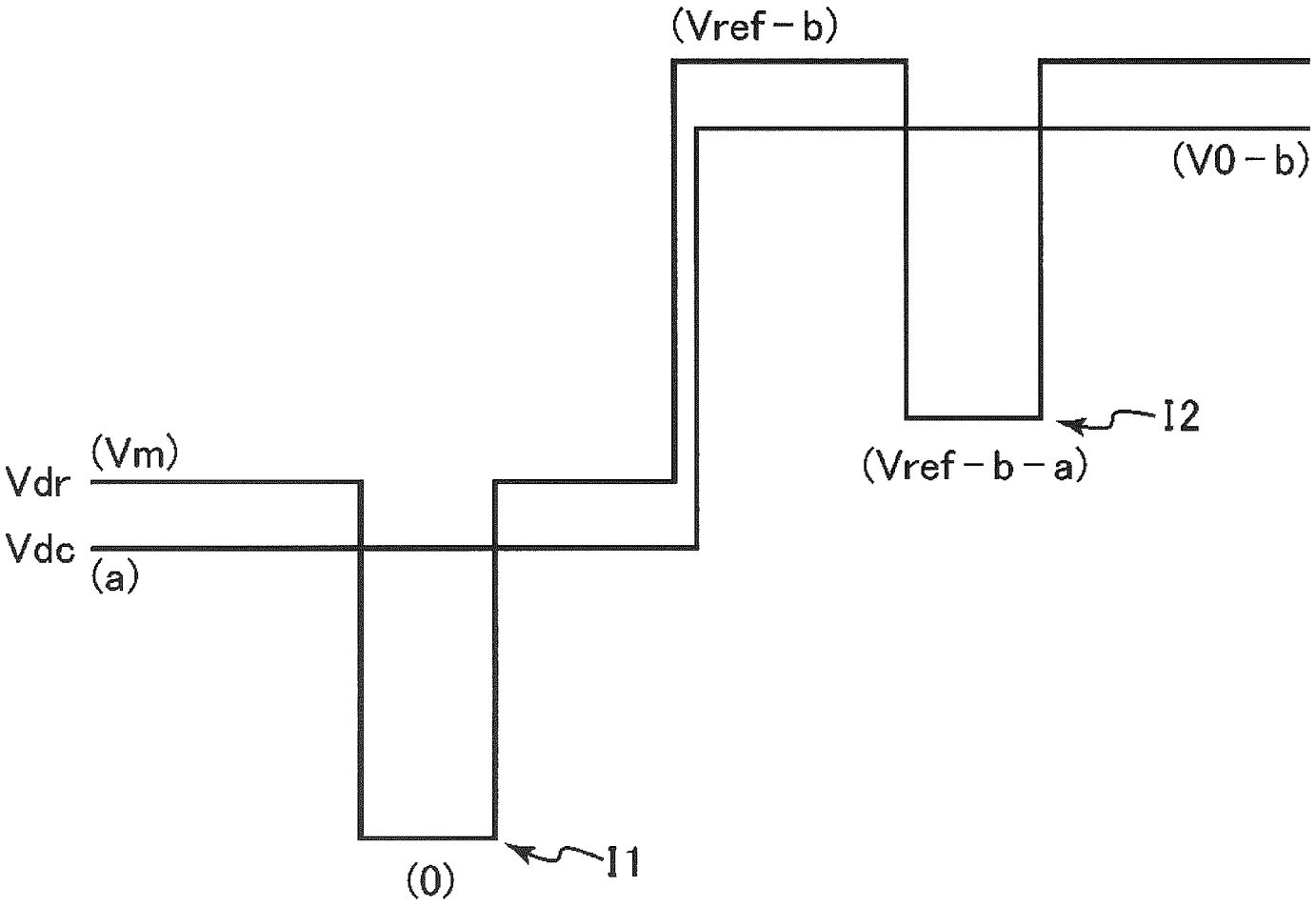
FIG. 7 schematically illustrates an electric potential relationship of the charging bias adjusting operation according to a second embodiment of the disclosure.

The following describes the charging bias adjusting operation according to a second embodiment of the disclosure. FIG. 7 is a schematic view illustrating an electric potential relationship between the photoreceptor drum 20 and the developing roller 23C in the charging bias adjusting operation according to the embodiment. Compared with the above-described first embodiment, this embodiment partially differs in formation of the band latent image 2 at Step S4 and development of the band latent image 2 at Step S5. Therefore, the following describes only these differences and omits descriptions on other common control aspects.

With reference to FIG. 7, this embodiment features the surface potential Vdr of the photoreceptor drum 20 during the formation of the band latent image 2 and a value of the developing bias Vdc during the development of the band latent image 2 among the charging bias adjusting operation. The values of the surface potential Vdr of the photoreceptor drum 20 when the band latent image 1 is formed and the developing bias Vdc when the band latent image 1 is developed are similar to those of the first embodiment.

At Step S4 in FIG. 3, the image condition adjusting unit 53 controls the charging bias applying unit 62 to apply a value found by subtracting b (V) (the second electric potential) from the preset charging bias Vref (Vref–b) to the charging roller 21A, thus setting the background portion electric potential. Additionally, to form the band latent image 2, the image condition adjusting unit 53 applies a value found by subtracting b (V) and a (V) (the first electric potential) from the preset charging bias Vref (Vref–b–a) to the charging roller 21A. Consequently, the band latent image 2 is formed on the photoreceptor drum 20. The storage unit 54 preliminary stores the threshold b (V). Additionally, at Step S5 in FIG. 3, the image condition adjusting unit 53 controls the developing bias applying unit 63 to apply a value found by subtracting b (V) from the target electric potential V0 for the photoreceptor drum 20 to the developing roller 23C. This forms the band toner image 2*a* by the electric potential difference (V0–Vref–a) between the developing roller 23C and the band latent image 2 (see 12 in FIG. 7). Accordingly, similar to the first embodiment, the image condition adjusting unit 53 is configured to decide the charging bias corresponding to the target electric potential V0 through the comparison between the print density D1 and the print density D2.

Additionally, in this embodiment, compared with the first embodiment, the developing bias that the developing bias applying unit 63 applies is reduced by b (V) during the charging bias adjustment. This restrains a cost increase of the developing bias applying unit 63, which is constituted of a high-voltage power supply.

Execution Timing of Charging Bias Adjusting Operation

The following describes the execution timing of the charging bias adjusting operation according to the above-described first and second embodiments (hereinafter referred to as the embodiments). In the image forming apparatus 10, when the surface potential of the photoreceptor drum 20 varies, an image defect such as a print density variation occurs. Accordingly, it is preferable to perform the charging bias adjusting operation under a condition where the surface potential of the photoreceptor drum 20 is likely to vary from the target electric potential V0. The following describes the preferable conditions.

First, it is preferable that the charging bias adjusting operation is performed when the image forming apparatus 10 is left for a long time after a termination of the previous image forming operation. In this case, temperature and humidity environments inside and outside the image forming apparatus 10 or a similar factor may vary or the property of the charging roller 21A of the charging apparatus 21 may change. In this embodiment, the image forming apparatus 10 includes the count unit 55 (see FIG. 2). The count unit 55 operates a difference between an end time of the previous image forming operation and a request time of the next image forming operation. In other words, the count unit 55 counts a printing interval period between sheets. When the printing interval period by the count unit 55 exceeds a preset threshold stored in the storage unit 54, it is only necessary for the image condition adjusting unit 53 to perform the charging bias adjusting operation prior to the next image forming operation. This prevents the image defect in association with the variation of the surface potential of the photoreceptor drum 20 even if the unused image forming apparatus 10 is left over a long period of time.

Secondary, if the temperature and humidity inside and outside the machine of the image forming apparatus 10 largely change, the charging bias adjusting operation is preferably performed. In this case, due to the variation of the temperature and humidity environments, the property of the charging roller 21A of the charging apparatus 21 may change. In this embodiment, the image forming apparatus 10 includes the environmental sensor 64 (see FIG. 2). Accordingly, if the temperature or the humidity detected by the environmental sensor 64 exceeds the preset threshold, which is stored in the storage unit 54, it is only necessary for the image condition adjusting unit 53 to perform the charging bias adjusting operation prior to the next image forming operation. This prevents the image defect in association with the variation of the surface potential of the photoreceptor drum 20 even if the temperature and humidity inside and outside the machine of the image forming apparatus 10 largely change. A detection timing of the temperature and humidity by the environmental sensor 64 may be performed at constant time intervals. If the temperature and humidity when the previous charging bias adjusting operation has been performed are stored in the storage unit 54 and amounts of variation from these stored temperature and humidity are large, whether to perform the charging bias adjusting operation or not may be determined.

Thirdly, if the number of printed sheets printed within a predetermined period exceeds the preset threshold stored in the storage unit 54, the image condition adjusting unit 53 may perform the charging bias adjusting operation. Continuous executions of the image forming operation over a long time are likely to vary the surface potential of the photoreceptor drum 20 due to a temperature rise of the photoreceptor drum 20, the property change of the charging roller 21A, or a similar cause. Accordingly, with the large number of printed sheets within the predetermined time, accurately adjusting the surface potential V0 of the photoreceptor drum 20 prevents the image defect.

Figure 8:
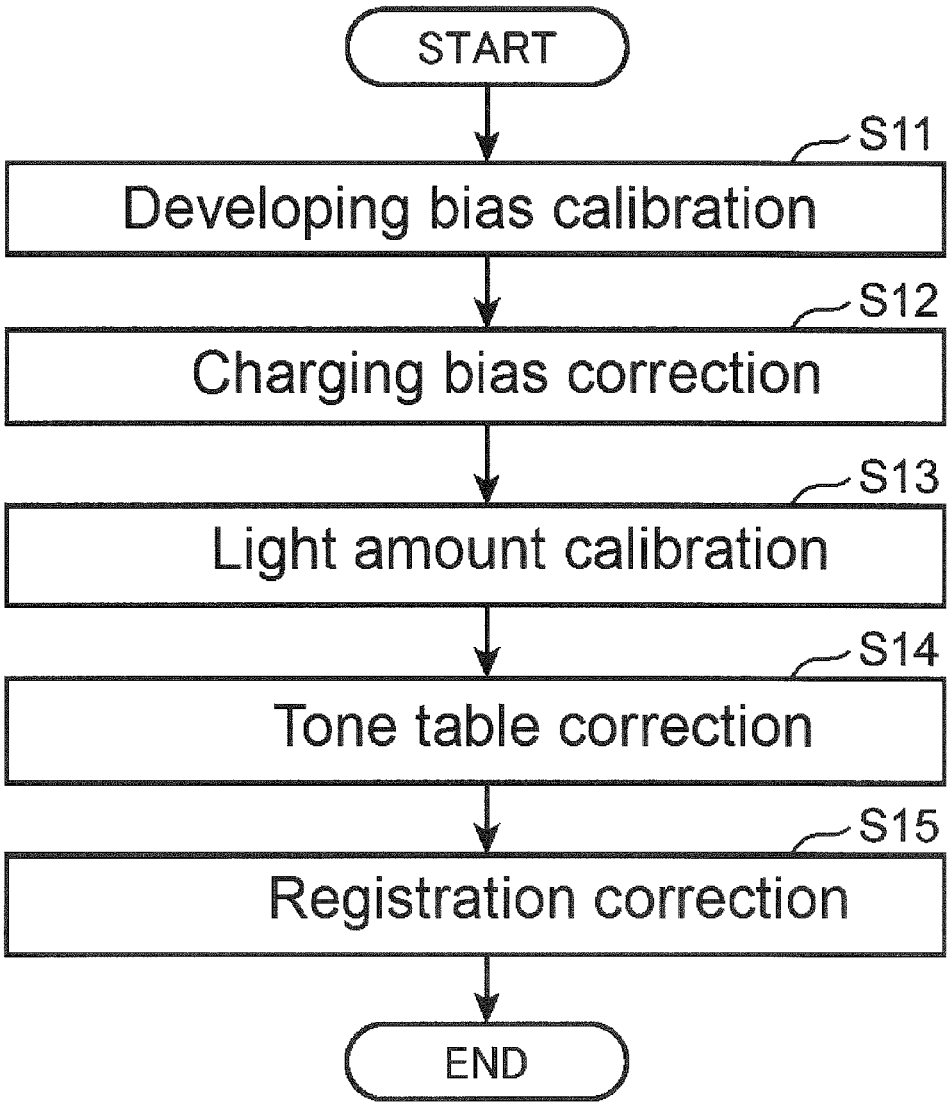
FIG. 8 illustrates a calibration operation according to the one embodiment of the disclosure.

The above-described execution timing of the charging bias adjusting operation may be almost identical to a timing of the calibration operation (adjustments of developability, an amount of exposure, and color shift correction) performed by the image forming apparatus 10. In view of this, the image condition adjusting unit 53 may perform the charging bias adjusting operation simultaneous with the execution of the calibration operation. FIG. 8 illustrates a flowchart of the calibration operation according to the embodiment. As one example, when the unused image forming apparatus 10 is left since the night on the previous day and a power supply of the image forming apparatus 10 is turned on in the morning of the next day, the image condition adjusting unit 53 performs the calibration operation in FIG. 8. The image condition adjusting unit 53 first performs a developing bias calibration (Step S11). This calibration adjusts the value of the DC bias of the developing bias, the waveform of the AC bias, and a similar factor according to a detection result of the temperature and humidity by the environmental sensor 64. Next, the image condition adjusting unit 53 performs the charging bias adjusting operation (the correction of charging bias) according to the embodiment (Step S12). Afterwards, the image condition adjusting unit 53 performs a light amount calibration of the exposure apparatus 22 (Step S13). Here, an amount of laser light of the exposure apparatus 22 is adjusted to obtain an appropriate print density for a halftone image. Afterwards, the image condition adjusting unit 53 performs a tone table correction (a print density tone adjustment calibration) (Step S14). Here, continuous tone print densities from a low print density area to a high print density area are adjusted. Afterwards, the image condition adjusting unit 53 performs a registration correction (Step S15). This adjusts a color shift correction of a full-color image or a similar defect.

Thus, in this embodiment, the image condition adjusting unit 53 performs the charging bias adjusting operation (Step S12), and then the calibration operation (Step S13), which adjusts the print density tone of the toner image, is performed. Accordingly, the print density tone of the toner image is adjusted with the surface potential V0 of the photoreceptor drum 20 stably held. This ensures obtaining a stable image quality in the subsequent image forming operation.

Correction of Charging Bias Vref

The following describes a third embodiment of the disclosure. Compared with the above-described first and second embodiments, this embodiment differs in predictive control of the charging bias Vref performed in advance. Therefore, the following describes only this difference and omits descriptions on other common control aspects. Vref, which is used in the charging bias adjusting operation, is preferably a value that can accurately reproduce the target surface potential V0 for the photoreceptor drum 20. However, the charging bias Vref required to reproduce the identical target electric potential V0 is likely to largely change due to the environment (the temperature and humidity), a period of using the photoreceptor drum 20 (a degree of deterioration of a surface layer of the photoreceptor drum 20), or a similar factor. In view of this, in this embodiment, the image condition adjusting unit 53 corrects the value of the charging bias Vref (the first tentative charging bias) according to a predetermined correction condition prior to the charging bias adjusting operation (see FIG. 3).

Table 1 shows an amount of correction of the charging bias Vref corrected by the image condition adjusting unit 53 when the temperature and the humidity detected by the environmental sensor 64 change. The storage unit 54 preliminary stores this amount of correction. As one example, with the detected temperature and humidity at 18 degrees and 30% RH, a value found by adding 76 V to a predetermined reference value is set as the charging bias Vref, and the charging bias adjusting operation is started. With this correction, even if the properties of the photoreceptor drum 20 and the charging apparatus 21 change according to the temperature and humidity, the adjusting operation is performed in the electric potential area close to the actual target electric potential V0. Therefore, the charging bias adjusting operation is quickly and accurately achieved.

TABLE 1

| | | Temperature (T° C.) | | | | | | | | | | | | | | |
|---|---|---|---|---|---|---|---|---|---|---|---|---|---|---|---|---|
| | | 0 | 5 | 12 | 14 | 16 | 18 | 20 | 22 | 23 | 24 | 26 | 28 | 30 | 32 | 40 |
| Humidity (H %) | 15% | 346 | 274 | 180 | 161 | 139 | 118 | 114 | 111 | 109 | 100 | 80 | 61 | 48 | 31 | −24 |
| | 20% | 337 | 265 | 173 | 150 | 127 | 104 | 98 | 93 | 90 | 81 | 62 | 44 | 31 | 16 | −31 |
| | 25% | 328 | 257 | 166 | 139 | 115 | 90 | 82 | 74 | 71 | 62 | 44 | 27 | 15 | 1 | −37 |
| | 30% | 319 | 248 | 159 | 129 | 102 | 76 | 66 | 56 | 51 | 43 | 26 | 10 | −2 | −14 | −43 |
| | 35% | 313 | 242 | 152 | 122 | 94 | 66 | 55 | 44 | 39 | 31 | 15 | 0 | −10 | −20 | −44 |
| | 40% | 307 | 236 | 146 | 115 | 86 | 57 | 44 | 32 | 26 | 18 | 4 | −10 | −18 | −26 | −45 |
| | 45% | 301 | 230 | 139 | 108 | 77 | 47 | 34 | 20 | 13 | 6 | −7 | −20 | −26 | −32 | −46 |
| | 50% | 295 | 224 | 132 | 100 | 69 | 38 | 23 | 8 | 0 | −6 | −18 | −31 | −35 | −39 | −47 |
| | 55% | 291 | 220 | 128 | 96 | 64 | 32 | 18 | 4 | −3 | −9 | −20 | −31 | −35 | −39 | −47 |
| | 60% | 287 | 216 | 124 | 91 | 58 | 26 | 13 | 0 | −6 | −11 | −21 | −32 | −35 | −39 | −47 |
| | 65% | 283 | 212 | 120 | 86 | 53 | 19 | 8 | −3 | −9 | −14 | −23 | −32 | −35 | −40 | −47 |
| | 70% | 279 | 208 | 116 | 82 | 47 | 13 | 3 | −7 | −12 | −16 | −24 | −33 | −36 | −40 | −47 |
| | 75% | 275 | 204 | 112 | 77 | 42 | 7 | −2 | −10 | −15 | −19 | −26 | −33 | −36 | −41 | −47 |
| | 80% | 271 | 200 | 108 | 72 | 37 | 1 | −7 | −14 | −18 | −21 | −28 | −34 | −36 | −41 | −47 |

Table 2 shows an amount of correction of the charging bias Vref corrected by the image condition adjusting unit 53 according to a driving period of the photoreceptor drum 20 detected by the count unit 55. The storage unit 54 preliminary stores this amount of correction. As one example, with the detected driving period of the photoreceptor drum 20 of 50 hours, a value found by adding 50 V to a predetermined reference value is set as the charging bias Vref and the charging bias adjusting operation is started. In this case, even if the charging characteristic of the photoreceptor drum 20 changes according to the driving period of the photoreceptor drum 20, the charging bias adjusting operation is quickly and accurately achieved. In another modified embodiment, the count unit 55 may count an accumulated application period of the charging bias by the charging apparatus 21. It is only necessary that the storage unit 54 preliminary stores correction values shown in Table 2 according to the accumulated application period of the charging bias. In this case as well, even if the charging characteristic of the charging roller 21A changes according to the accumulated application period of the charging bias, the charging bias adjusting operation is quickly and accurately achieved. With the above-described respective amounts of correction in combination with one another, the charging bias Vref may be adjusted by the temperature and humidity inside and outside of the machine of the image forming apparatus 10, the driving period of the photoreceptor drum 20, and a similar factor. The charging bias Vref may be adjusted according to other correction conditions. The above-described respective correction values may be stored not as a table but as a predetermined correction formula. After the above-described charging bias Vref is corrected, the charging bias adjusting operation similar to the above-described first or second embodiment is performed.

TABLE 2

| | | | | | | | | | |
|---|---|---|---|---|---|---|---|---|---|
| Photoreceptor driving time [Time] | 0 | 10 | 20 | 30 | 40 | 50 | 60 | 500 | 1000 |
| Amount of Vref correction [V] | 0 | 10 | 20 | 30 | 40 | 50 | 60 | 60 | 50 |

The image forming apparatus 10 according to the embodiments of the disclosure is described above in detail; however, the disclosure is not limited to this. The disclosure can employ, for example, the following modified embodiments.

(1) The above-described respective embodiments describe the aspect that the toner is charged to a positive polarity; however, the disclosure is not limited to this. When the toner is charged to a negative polarity, the similar charging bias adjustment control is executable with polarities of the above-described respective biases inverted.

(2) The above-described embodiments describe the aspect that the image forming apparatus 10 is the full-color image forming apparatus; however, the disclosure is not limited to this. The image forming apparatus 10 may be a monochrome printer or a similar printer that forms a single color image.

(3) The above-described first embodiment describes the aspect that the one band latent image 2 (the band toner image 2*a*) is formed from Step S4 to Step S6 in FIG. 3; however, the disclosure is not limited to this. In another embodiment, while the a value in FIG. 4 is changed, a plurality of the band latent images may be formed. In this case, the image condition adjusting unit 53 can accurately detect the difference between Vref and the target electric potential V0 from a print density measurement result of the plurality of band toner images 2*a*.

(4) The above-described first embodiment describes the aspect that the value a (V) of the developing bias applied to the developing roller 23C when the band latent image 1 is formed is identical to a value of the electric potential difference a (V) subtracted from the charging bias Vref when the band latent image 2 is formed; however, the disclosure is not limited to this. Both values may not be identical values. When different values are applied, it is only necessary that the value of the charging bias derived by the difference between both is corrected at Step S7 in FIG. 3.

WORKING EXAMPLES

The following further describes the embodiments of the disclosure in detail with the working examples; however, the disclosure is not limited to only the following working examples.

Working Example 1

With the above-described image forming apparatus 10 according to the first embodiment, under conditions that the distance on the circumference surface of the photoreceptor drum 20 from the developing device 23 to the charging apparatus 21 in FIG. 5 is 60 mm (a rotation period of the photoreceptor drum 20: 0.4 sec) and the distance on the circumference surface of the photoreceptor drum 20 from the primary transfer roller 24 to the charging apparatus 21 is 30 mm (a rotation period of the photoreceptor drum 20: 0.2 sec), a peripheral velocity of the photoreceptor drum 20 is set to 150 mm/sec. Similar to the first embodiment, corresponding to the non-charged area, the primary transfer bias and the AC bias of the developing bias are preliminary turned off. The measurement of the surface potential at the non-charged area on the photoreceptor drum 20 by a surface electrometer for experiment turned out to be 0 V.

In this Working Example 1, at Step S2 in FIG. 3, the band latent image 1 was developed at a developing bias Vdc=a=150 V and the band toner image 1*a* was formed. This resulted in print density D1=0.52. Next, at Step S4, to obtain the target electric potential V0, the charging bias Vref=1350 V was tentatively applied, and Vref−a (V)=1200 V was applied to form the band latent image 2. Afterwards, at Step S5, the developing bias Vdc=target electric potential V0=450 (V) was set to form the band toner image 2*a*. This resulted in print density D2=0.42. From this result, from the relationship of print density D1> print density D2, a value found by subtracting 10 (V) from the above-described charging bias Vref was set as a charging bias Vref after correction=1340 (V). While the image condition adjusting unit 53 controlled the charging bias applying unit 62 to apply the charging bias Vref=1340 (V), the surface potential of the photoreceptor drum 20 was actually measured. This resulted in V0=460 (V).

On the other hand, at Step S4, to obtain the target electric potential V0, the charging bias Vref=1330 V was tentatively applied, and Vref−a (V)=1180 V was applied to form the band latent image 2. Afterwards, at Step S5, the developing bias Vdc=target electric potential V0=450 (V) was set to form the band toner image 2*a*. This resulted in print density D2=0.52. In this case, since print density D1=print density D2 was met, the charging bias Vref=1330 V was decided as the charging bias corresponding to the target electric potential V0=450 (V).

Working Example 2

Compared with Working Example 1, Working Example 2 turns on the AC bias of the developing bias corresponding to the non-charged area. The measurement of the surface potential at the non-charged area on the photoreceptor drum 20 by the surface electrometer for experiment turned out to be −5 V. The measurement result of the print density in Working Example 2 is omitted.

Working Example 3

Compared with Working Example 1, Working Example 3 turns on the primary transfer bias and the AC bias of the developing bias corresponding to the non-charged area. The measurement of the surface potential at the non-charged area on the photoreceptor drum 20 by the surface electrometer for experiment turned out to be −20 V.

In this Working Example 3, at Step S2 in FIG. 3, the band latent image 1 was developed at a developing bias Vdc=a=150 V and the band toner image 1*a* was formed. This resulted in print density D1=0.62. Next, at Step S4, to obtain the target electric potential V0, the charging bias Vref=1350 V was tentatively applied, and Vref−a (V)=1200 V was applied to form the band latent image 2. Afterwards, at Step S5, developing bias Vdc=target electric potential V0=450 (V) was set to form the band toner image 2*a*. This resulted in print density D2=0.42. From this result, from the relationship of print density D1> print density D2, a value found by subtracting 10 (V) from the above-described charging bias Vref was set as a charging bias Vref after correction=1340 (V). While the image condition adjusting unit 53 controlled the charging bias applying unit 62 to apply the charging bias Vref=1340 (V), the surface potential of the photoreceptor drum 20 was actually measured. This resulted in V0=460 (V).

On the other hand, at Step S4, to obtain the target electric potential V0, the charging bias Vref=1330 V was tentatively applied, and Vref−a (V)=1180 V was applied to form the band latent image 2. Afterwards, at Step S5, developing bias Vdc=target electric potential V0=450 (V) was set to form the band toner image 2*a*. This resulted in print density D2=0.52. In this case, since print density D1> print density D2 was met, a value found by further subtracting 10 (V) from the above-described charging bias Vref was set as a charging bias Vref after correction=1320 (V). While the image condition adjusting unit 53 controlled the charging bias applying unit 62 to apply the charging bias Vref=1320 (V), the surface potential of the photoreceptor drum 20 was actually measured. This resulted in V0=440 (V). Consequently, the charging bias Vref=1320 V was decided as the charging bias corresponding to the target electric potential V0.

The above-described all working examples decide the charging bias corresponding to the target electric potential V0 for the photoreceptor drum 20 with simple configuration. Further, like Working Example 1, preliminary turning off the primary transfer bias and the AC bias of the developing bias corresponding to the non-charged area ensures execution of the charging bias adjusting operation with the less number of steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body;

a photoreceptor drum that has a circumference surface on which an electrostatic latent image including a background portion and an image portion is formed, the photoreceptor drum being rotationally driven in a predetermined rotation direction;

a charging apparatus arranged in contact with or close to the circumference surface of the photoreceptor drum, the charging apparatus charging the circumference surface at a predetermined electric potential;

a developing device that includes a developing roller disposed opposed to the photoreceptor drum, the developing device supplying the photoreceptor drum with toner to develop the electrostatic latent image into a toner image;

a transfer apparatus that transfers the toner image from the photoreceptor drum to a sheet or an intermediate transfer belt;

a charging bias applying unit that applies a predetermined charging bias to the charging apparatus;

a developing bias applying unit that applies a predetermined developing bias to the developing roller;

a bias adjusting unit that performs a charging bias adjusting operation, the charging bias adjusting operation adjusting an electric potential at the background portion in the electrostatic latent image on the photoreceptor drum to a predetermined target electric potential; and a print density measurement unit that measures a print density of the toner image, wherein the bias adjusting unit:

in the charging bias adjusting operation, controls the charging bias applying unit to form a non-charged area to which the charging bias is not applied on the circumference surface of the photoreceptor drum, and controls the developing bias applying unit to apply the developing bias constituted of a first electric potential to the developing roller, so as to form a first toner image by an electric potential difference between the non-charged area and the developing roller, in the charging bias adjusting operation, controls the charging bias applying unit to apply the charging bias found by subtracting the first electric potential from a first tentative charging bias preset corresponding to the target electric potential to form a predetermined electric potential area on the circumference surface of the photoreceptor drum, and controls the developing bias applying unit to apply the target electric potential to the developing roller, so as to form a second toner image by an electric potential difference between the electric potential area and the developing roller, and decides a value of the charging bias corresponding to the target electric potential from measurement results of print densities of the first toner image and the second toner image measured by the print density measurement unit, and wherein the developing bias applying unit applies the developing bias configured by superimposing an AC bias to a DC bias, and in the charging bias adjusting operation, the bias adjusting unit stops the AC bias of the developing bias before an area corresponding to the non-charged area in the circumference surface of the photoreceptor drum passing through the charging apparatus and when passing through the developing device.

2. An image forming apparatus comprising:

an apparatus main body;

a photoreceptor drum that has a circumference surface on which an electrostatic latent image including a background portion and an image portion is formed, the photoreceptor drum being rotationally driven in a predetermined rotation direction;

a charging apparatus arranged in contact with or close to the circumference surface of the photoreceptor drum, the charging apparatus charging the circumference surface at a predetermined electric potential;

a developing device that includes a developing roller disposed opposed to the photoreceptor drum, the developing device supplying the photoreceptor drum with toner to develop the electrostatic latent image into a toner image;

a transfer apparatus that transfers the toner image from the photoreceptor drum to a sheet or an intermediate transfer belt;

a charging bias applying unit that applies a predetermined charging bias to the charging apparatus;

a developing bias applying unit that applies a predetermined developing bias to the developing roller;

a bias adjusting unit that performs a charging bias adjusting operation, the charging bias adjusting operation adjusting an electric potential at the background portion in the electrostatic latent image on the photoreceptor drum to a predetermined target electric potential; and a print density measurement unit that measures a print density of the toner image, wherein the bias adjusting unit:

in the charging bias adjusting operation, controls the charging bias applying unit to form a non-charged area, to which the charging bias is not applied, on the circumference surface of the photoreceptor drum, and controls the developing bias applying unit to apply the developing bias constituted of a first electric potential to the developing roller, so as to form a first toner image by an electric potential difference between the non-charged area and the developing roller, in the charging bias adjusting operation, controls the charging bias applying unit to apply the charging bias found by subtracting the first electric potential and a preset second electric potential from a first tentative charging bias preset corresponding to the target electric potential to form a predetermined electric potential area on the circumference surface of the photoreceptor drum, and controls the developing bias applying unit to apply the developing bias found by subtracting the second electric potential from the target electric potential to the developing roller, so as to form a second toner image by an electric potential difference between the electric potential area and the developing roller, and decides a value of the charging bias corresponding to the target electric potential from measurement results of print densities of the first toner image and the second toner image measured by the print density measurement unit, and wherein the developing bias applying unit applies the developing bias configured by superimposing an AC bias to a DC bias, and in the charging bias adjusting operation, the bias adjusting unit stops the AC bias of the developing bias before an area corresponding to the non-charged area in the circumference surface of the photoreceptor drum passing through the charging apparatus and when passing through the developing device.

3. The image forming apparatus according to claim 1, wherein in the charging bias adjusting operation, when the print density of the first toner image is higher than the print density of the second toner image, the bias adjusting unit decides a value smaller than the first tentative charging bias as the charging bias corresponding to the target electric potential, and when the print density of the first toner image is lower than the print density of the second toner image, the bias adjusting unit decides a value larger than the first tentative charging bias as the charging bias corresponding to the target electric potential.

4. The image forming apparatus according to claim 3, wherein in the charging bias adjusting operation, the bias adjusting unit controls the charging bias applying unit to apply a predetermined intermediate charging bias, so as to set a background portion electric potential before and after the predetermined rotation direction of the non-charged area, and the intermediate charging bias is set smaller than the target electric potential.

5. The image forming apparatus according to claim 1, further comprising:

a transfer bias applying unit that applies a predetermined transfer bias to the transfer apparatus, wherein in the charging bias adjusting operation, the transfer bias is not applied to the circumference surface of the photoreceptor drum corresponding to the non-charged area by the transfer bias applying unit.

6. The image forming apparatus according to claim 1, further comprising an environment detector that detects a surrounding temperature or humidity, wherein when the temperature or the humidity detected by the environment detector exceeds a preset threshold, the bias adjusting unit performs the charging bias adjusting operation.

7. The image forming apparatus according to claim 1, further comprising a count unit that counts a count of printed sheets of the sheets to which the toner image is transferred, wherein when the count of printed sheets printed within a predetermined period exceeds a preset threshold, the bias adjusting unit performs the charging bias adjusting operation.

8. The image forming apparatus according to claim 1, further comprising a count unit that counts a printing interval period between the sheets to which the toner image is transferred, wherein when the printing interval period exceeds a preset threshold, the bias adjusting unit performs the charging bias adjusting operation.

* * * * *